US006094954A

United States Patent [19]

Carmen

[11] Patent Number: 6,094,954

[45] Date of Patent: Aug. 1, 2000

[54] KEY ASSEMBLY WITH APERTURE, SLOT AND INSERT

[76] Inventor: Norman M. Carmen, 4101 Powder Mill Rd., Beltsville, Md. 20705

[21] Appl. No.: 09/145,652

[22] Filed: Sep. 2, 1998

[51] Int. Cl.[7] ..... E05B 19/04

[52] U.S. Cl. ..... 70/408; 70/460; 70/406; 40/330

[58] Field of Search ..... 70/408, 460, 405, 70/406, 456 R; 24/3.6; 40/330, 634

[56] References Cited

U.S. PATENT DOCUMENTS

| | | | |
|---|---|---|---|
| 312,545 | 2/1885 | Zeilin | 40/330 |
| 1,032,930 | 7/1912 | Moseley | 70/330 |
| 1,322,815 | 11/1919 | Patterson | 40/330 |
| 2,533,006 | 12/1950 | Goldsmith | 40/330 |
| 2,566,749 | 9/1951 | Rothe | 40/330 |
| 3,209,479 | 10/1965 | Manzardo . | |
| 3,324,586 | 6/1967 | Mitchell | 40/330 |
| 4,188,741 | 2/1980 | Levy | 40/330 |
| 4,305,267 | 12/1981 | Nish et al. | 70/395 |
| 4,403,487 | 9/1983 | Marty . | |
| 4,417,410 | 11/1983 | Freedom | 40/330 |
| 5,083,662 | 1/1992 | Bishop et al. | 70/456 R |
| 5,181,605 | 1/1993 | Bishop et al. . | |

FOREIGN PATENT DOCUMENTS

| | | | |
|---|---|---|---|
| 2319122 | 10/1974 | Germany | 70/395 |
| 2408468 | 3/1975 | Germany | 70/395 |
| 197803 | 3/1978 | Germany | 70/408 |
| 2218463 | 11/1989 | United Kingdom | 70/408 |

*Primary Examiner*—Darnell Boucher
*Attorney, Agent, or Firm*—Lane, Aitken & McCann L.L.P.

[57] ABSTRACT

A key and insert assembly is designed for the identification of keys or key blanks. The key is provided with a slot through the key head which is oriented in a plane parallel with the face of the key head. A window through the key head intersects the slot. The slot is designed to receive a thin insert made of synthetic resin and the window area allows a portion of the insert to be displayed. Information regarding the key or other codes may be printed on the insert region which is displayed. In a preferred embodiment, the insert is retained in the slot by a snap-fit arrangement.

14 Claims, 3 Drawing Sheets

KEY ASSEMBLY WITH APERTURE, SLOT AND INSERT

INTRODUCTION

This invention relates to keys and blanks used for the creation of keys.

There are a number of manners in which to provide information relating to a particular key or key blank. Frequently, a unique serial number is provide on the key or key blank which can be interpreted using a corresponding code and knowledge regarding the key shape. In the consumer market, there are also a number of methods used to provide information relating to a particular key. U.S. Pat. No. 5,181,605 to Bishop et al., U.S. Pat. No. 5,083,662 to Bishop et al., U.S. Pat. No. 3,209,479 to Manzardo and U.S. Pat. No. 4,403,487 to Marty, each respectively, address some common approaches to correlate information to keys.

SUMMARY OF THE INVENTION

The present invention relates to an improved key assembly to provide for the easy and interchangeable identification of a key or key blank. According to the invention, a key is provided which is made in a conventional manner having a flat planar head or handle area and a shaft or shank from which the unique teeth arrangement project. A window area is provided through the key head area which provides a passage from one side of the key head to the other. A slot is provided through the key head which is oriented in a plane parallel with the top and bottom of the key head. The slot can be accessed from a lateral side of the key head and a portion of the slot intersects the window area. It is contemplated that the slot can take a number of distinct dimensions and shapes, some of which are disclosed in the drawings provided herein.

An insert is provided to fit within the slot which can be provided with identification means, such as printed matter. In the appended drawings, the printed matter is depicted as "B47" to represent a code which corresponds to the type of key or a code to identify what lock or locks the key will open. The insert can be made from a variety of materials and/or colors to assist in the identification of the key. For example, a transparent insert could be provided so that written material relating to the key can be displayed in the window area behind a protective cover. The invention provides a convenient manner in which to identify keys (or key blanks used to replicate keys) and the inserts can be easily changed as circumstances dictate. The insert can be held within the slot area in a number of manners including snap-fit arrangements, adhesives, frictional engagement or other mechanical engagements. For example, the insert can be made having variable thickness wherein the area displayed in the window area can be manufactured having a greater thickness than the area occupying the remainder of the slot. In another embodiment of the invention the insert is retained in the slot by an annular elastomeric retainer ring which surrounds the key head.

According to yet a further embodiment of the invention, a portion of the insert can be removed or "punched out" of the total window area. It is further contemplated that an insert can be provided where only a portion of the area displayed in the window is removed to allow for integration on a conventional key chain. Likewise, an extension can be provided on the insert which extends away from the key head. Such an extension could be designed to tear away by providing perforating through the extension. In yet another embodiment of the invention, the insert can contain unique identification means such as a magnetic code.

According to another embodiment of the invention, the window area does not completely traverse the key head but only extends approximately two thirds of the distance of the width of the key head where it intersects the slot. In this embodiment, the insert is displayed on only one side of the key.

The use of a slot through a key head provides a convenient to securely retain an insert which can contain information relating to the key. The slot can be formed in a wide variety of ways including when the key itself is stamped or die cast. The slot can be formed by conventional machining techniques or made from a plurality of components and later assembled.

DESCRIPTION OF A PREFERRED EMBODIMENT

Figure 1:
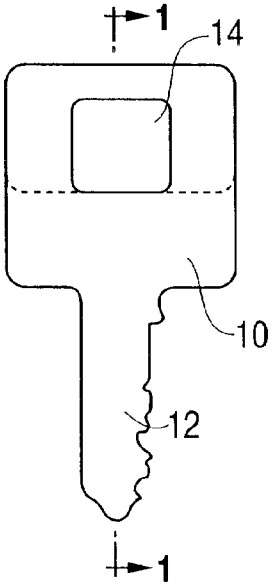
FIG. 1 is a front view of a key according to the invention
Figure 2:
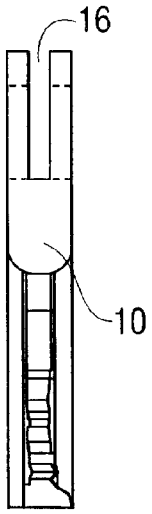
FIG. 2 is a side view in elevation of the embodiment of the key shown in FIG. 1.
Figure 9:
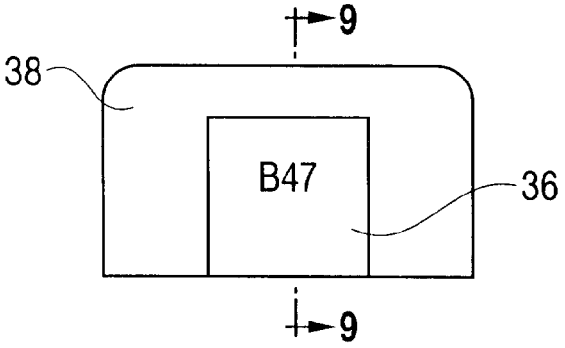
FIG. 9 is a front view of an insert which can be used in either the first or third embodiment of the invention.
Figure 10:
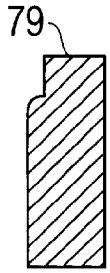
FIG. 10 is a side sectional view of the insert along line 9—9.
Figure 11:
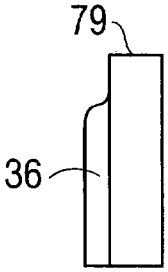
FIG. 11 is a side view in elevation of the insert shown in FIG. 9.
Figure 12:
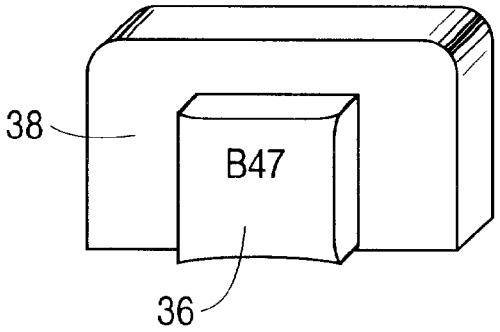
FIG. 12 shows a isometric view of the insert of FIG. 9.

FIG. 1 shows a key according to the invention consisting of a head 10 and shank 12. Head 10 has a window or an aperture 14 which provides a passage from the front to the rear of the key. As best seen in FIG. 2 (not drawn to scale) slot 16 is provided through the key head 10 a distance about halfway down the key head and intersects the aperture 14. The key as depicted in FIG. 1 is constructed to receive the insert of FIG. 9 within slot 16. The insert has identification material printed on the area 36 of the insert which, when seated in slot 16, is visible through aperture 14. As best seen in FIGS. 10–12 (not drawn to scale), area 36 of the insert which is visible through the aperture is made having a greater width than the remainder of the insert area 38. The insert of FIG. 9 is preferably made of an elastic or resilient material which will compress when received in the slot 16. For example, the insert could be constructed from synthetic resins such as polyethylene, nylon, acrylic or polypropylene which have some elastic and resilient properties. Referring now to the configuration disclosed in FIG. 9, the area 36 of the insert is received within the slot 16, the area 36 is compressed until it reaches the aperture area where it is allowed to expand to its original shape. When the area 36 is properly aligned with the aperture 14, area 36 can thus expand and thus serves to secure the insert in place. In an alternative embodiment, elasticity or resilience can be provided by making an insert in a "U" shape wherein the respective ends of the "U" can be displaced towards each other.

Figure 3:
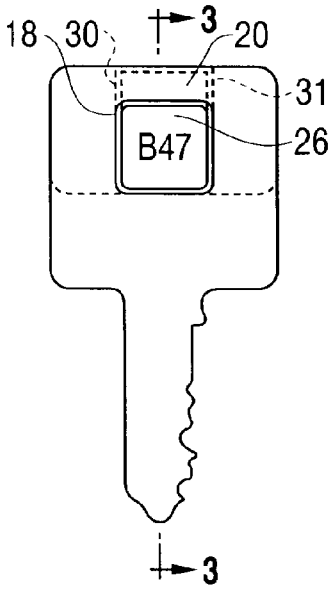
FIG. 3 is a front view in elevation of a key and insert according to a second embodiment of the invention.
Figure 4:
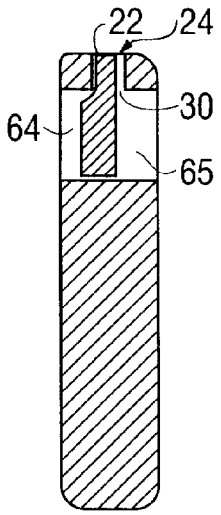
FIG. 4 is a cross section of the embodiment of the invention shown in FIG. 3 along lines 3—3.

The key depicted in FIG. 3 shows an embodiment where the slot is accessible from only one lateral side of the key head and therefore the insert may only be seated or unseated within the slot using reciprocity movement. Window 18 provides an avenue in which to view region 26 which may contain printed material regarding the key, or key blank.

Figure 16:
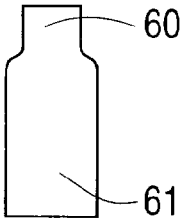
FIG. 16 shows a side view in elevation of a second insert compatible with the key depicted in FIG. 3.
Figure 17:
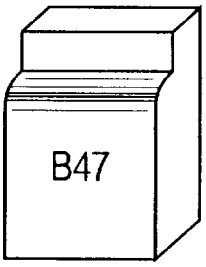
FIG. 17 is an isometric view of a second embodiment of an insert compatible with the key depicted in FIG. 3.
Figure 18:
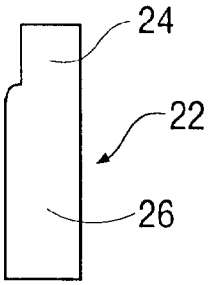
FIG. 18 is a side view of the insert shown in FIG. 17.
Figure 21:
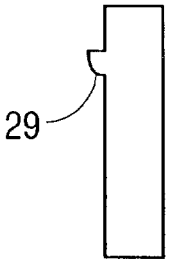
FIG. 21 is a side view of a further embodiment of an insert depicting a projection ridge.
Figure 22:
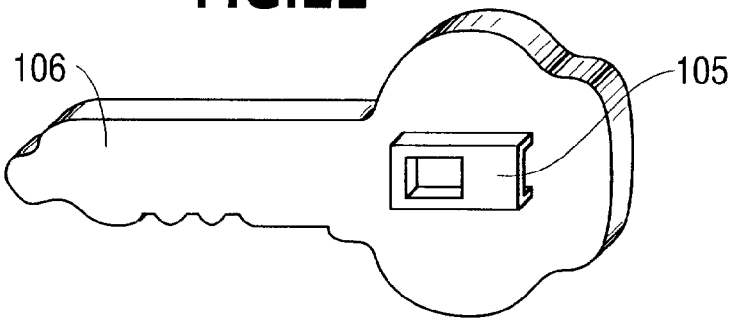
FIG. 22 is a further embodiment of a key and slot arrangement.
Figure 23:
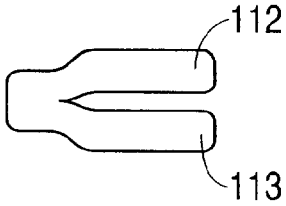
FIG. 23 is a further embodiment of the invention.

As depicted in FIG. 3, slot 24 is accessible from the top side of the key. However, it is contemplated that a slot could be oriented with respect to the key head in other directions. Lateral movement of the insert 22 is restricted by the sidewalls 30 and 31 of the slot. Insert 22 is made of two regions 24 and 26 which have different thicknesses. The width of region 24 is less than or equal to the width of the slot. Region 26 is slightly larger than the width of the slot and, when inserted into the slot, this region 26 is slightly compressed. When the region is aligned with the window area 26, the region 26 expands to a width slightly larger than the width of the slot. Made in accordance with this teaching the insert is securely seated and retained within the slot. FIG. 16 shows an alterative embodiment where both region 60 and region 61 are symmetrically arranged in relation to a plane oriented down the center of the insert and parallel with the front face of the key. Here region 61, the area extends the same distance from a plane through the center of the insert part. In this embodiment, the region 61 can extend both into forward window area 64 and rearward window region 65. FIG. 21 shows a further embodiment of an insert compatible with the key design depicted in FIG. 3. In this embodiment, a ridge 29 is provided which serves to retain the insert within the slot and restrict reciprocity movement. Lateral movement of the insert is restricted by the sidewalls 30 and 31 of the slot as shown in FIG. 3.

Figure 5:
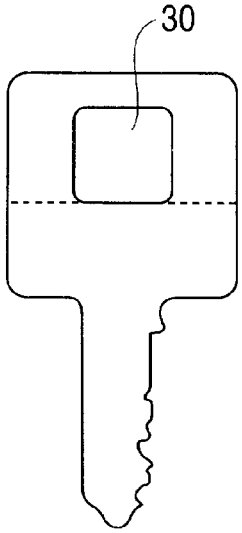
FIG. 5 is a front view in elevation of a key according to a third embodiment of the invention.
Figure 6:
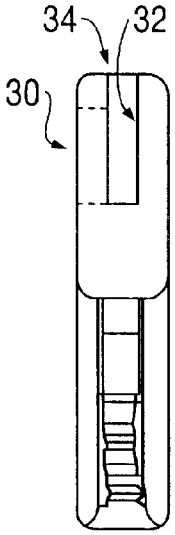
FIG. 6 is a side view in elevation of the key shown in FIG. 5.

FIGS. 5 and 6 show a further embodiment of the invention wherein a window 30 allows visibility of a compatible insert from only one side of the key. In this regard, when the insert is not seated within the slot, surface 32 of the slot is visible through window 30.

Figure 7:
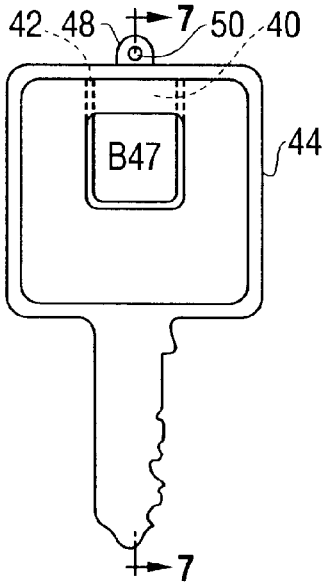
FIG. 7 is a front view in elevation of a key according to the second embodiment of the invention with a retainer ring around the key head.
Figure 8:
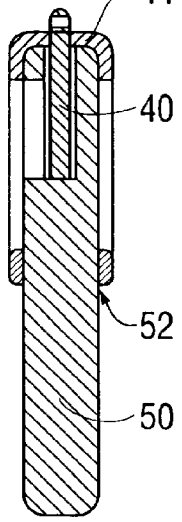
FIG. 8 is a cross sectional view along line 7—7.
Figure 8A:
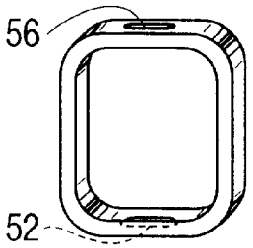
FIG. 8*a* is an isometric view of retainer ring 44.
Figure 15:
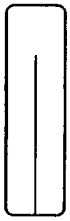
FIG. 15 shows a side view of an insert which can be used with the embodiment of the key shown in FIG. 2.

FIGS. 7 and 8 depict an alterative manner in which to retain an insert within a slot. In this embodiment, an insert with surfaces such as that depicted in FIG. 15 which has a uniform thickness is kept within the slot by an annular retaining ring 44. The ring 44, has a "U" shaped sectional profile and is provided with a suitable aperture 52 to allow the key shank 50 to extend down from the key head. A second aperture 56 is also provided in this embodiment which allows for projection 48 of the insert member 40 to extend from the key head. The projection 48 is provided with an aperture 50 to be received by a conventional key ring. The retainer ring 44 is made of a resilient and deformable material which facilitates the acceptance of a key to the ring.

Figure 19:
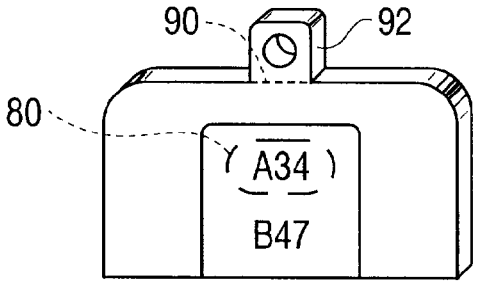
FIG. 19 is a further embodiment of an insert which is compatible with the key according to the first and third embodiments of the invention.
Figure 20:
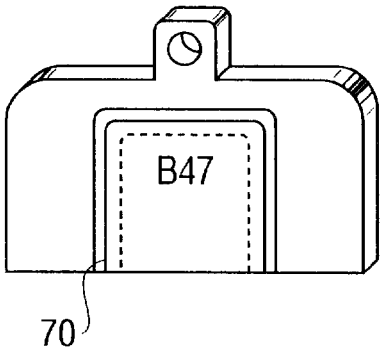
FIG. 20 is yet another embodiment of the insert compatible with the first and third embodiments of the invention.

FIGS. 19 and 20 depict a further embodiment of an insert which has perforated areas that can be punched out or removed. In FIG. 20, a large area of the central region 70 can be punched out which may contain information relating to the key. This embodiment may be appropriate for use when the information provided on the insert relates to the type of key blank used. The remainder of the insert is retained within the slot by a "U" shaped ridge 70 which corresponds to three sides of the window through the key. In FIG. 19, a region 80 within the display area 81 of the insert can be punched out by providing a perforated construction containing information relating to the key or key blank or merely be provided to allow for acceptance on a key chain or ring. In this embodiment, significant area of the insert within the window region remains visible after removal of the punch out section 80. The punch out region 80 is depicted with information "A34" for identification purposes which therefore slows information which can be removed. The insert is shown with an extension 92 which can also be removed from the insert by tearing or breaking along perforation 90.

Figure 13:
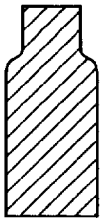
FIG. 13 shows a side sectional view of a second embodiment of an insert appropriate for use in the embodiment of the key shown in FIG. 1.
Figure 14:
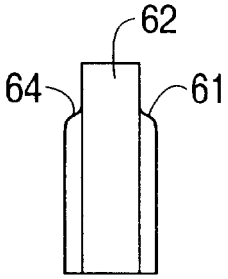
FIG. 14 shows a side view of the insert of the insert of FIG. 13 in elevation.

FIGS. 10 and 11 show a further embodiment of an insert 79 appropriate for use with the keys shown in FIGS. 5 and 6. This insert has raised region 36 extending from only one side of the insert. As best seen in FIG. 12, the region 38 contained within the slot will not be visible through the window area 30 when inserted into the key depicted in FIG. 5. The insert shown in FIGS. 13 and 14 has symmetry along a central plane more appropriate for use with the key shown in FIGS. 1–2 which has a through window. This insert has region 64 which extends forwardly and region 61 extending rearwardly.

FIG. 21 shows a further embodiment of the invention wherein the slot structure 105 is provided on the top surface of the key head 106. The slot according to this embodiment can be used in conjunction with the inserts made in accordance with those disclosed in FIGS. 15, 17, 18, and 21.

Although the applicant has disclosed retaining rings and snap-fit arrangements to retain the insert in the slot, the applicant contemplates that other fastening means such as adhesives or mechanical fasteners could be used, without departing from the spirit or scope of the invention. It is further contemplated that any of the structures and depicted herein can be combined in a wide variety of manner, and each such combination be optimized for the intended use of the key, or key blank.

What is claimed is:

1. A key and insert assembly comprising a key having a shank and head, said head and shank comprised of a single, integral, one-piece part having opposite top and bottom planer surfaces and a sidewall, said sidewall having a width, a slot with an opening through said sidewall, said opening having a width less than the width of said head, said slot having upper and lower surfaces coplanar with said top and bottom surfaces of said head, a window through said head forming a perpendicular passage from said top planar surface to said slot, and an insert, said insert having means to display written information on a display region and said insert is slidably received in said slot, and wherein said display region is visible through said window and means to retain said insert within said slot.

2. The key and insert assembly as recited in claim 1 wherein said means to retain said insert within said slot comprises an area on said display insert region which has a width greater than the width of said slot.

3. The key and assembly as recited in claim 2 wherein said area of said insert is comprised of an elastic and compressible material thereby allowing said area to be compressed as it is received in said slot and allowing said area to expand when it enters said window area thereby securing said insert within said slot.

4. The key and insert assembly as recited in claim 3 wherein said area comprises a projecting ridge.

5. The key and insert assembly as recited in claim 3 wherein said insert is entirely comprised of an elastic and compressible material.

6. The key and insert assembly as recited in claim 5 wherein said insert is made of a synthetic resin.

7. The key and insert assembly of claim 6 wherein said synthetic resin is comprised of material from a group consisting of polypropylene, polyethylene, nylon and acrylic.

8. The key and insert assembly as recited in claim 1 wherein said slot further comprises sidewalls and said opening is adapted for reception and release of said insert in a reciprocating fashion.

9. The key and insert assembly as recited in claim 7 wherein said slot further comprises end walls and defines a rectilinear shape.

10. The key and insert assembly as recited in claim 1 wherein said means to retain said insert within said slot comprises an elastomeric annular band.

11. The key and insert assembly as recited in claim 1 wherein said means to retain said insert within said slot comprises adhesive.

12. The key and insert assembly as recited in claim 1 wherein said window extends from said top surface, intersects said and extends through said bottom surface thereby forming a perpendicular passage through said key head.

13. The key and insert assembly as recited in claim 1 further comprising means to facilitate the removal of a portion of said display insert region which is visible through said window area.

14. The key and insert assembly as recited in claim 13 wherein said means to facilitate the removal comprise perforations through said insert.

* * * * *